US012669315B1

(12) United States Patent
Swenston et al.

(10) Patent No.: US 12,669,315 B1
(45) Date of Patent: Jun. 30, 2026

(54) MODULAR EXPLODING FOIL INITIATOR ASSEMBLY

(71) Applicant: Reynolds Systems, Inc., Middletown, CA (US)

(72) Inventors: Daniel Swenston, Middletown, CA (US); Brent Chicoine, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 19/051,688

(22) Filed: Feb. 12, 2025

(51) Int. Cl.
*F42B 3/12* (2006.01)

(52) U.S. Cl.
CPC ..... *F42B 3/125* (2013.01)

(58) Field of Classification Search
CPC ..... F42B 3/103; F42B 3/125
See application file for complete search history.

(56) References Cited

U.S. PATENT DOCUMENTS 3,135,200 A * 6/1964 Jackson ..... F42B 3/127 102/202.9
4,014,264 A * 3/1977 Bendler ..... F42C 19/12 102/202.8
4,306,499 A * 12/1981 Holmes ..... F42B 3/18 102/202.4
4,625,645 A * 12/1986 Williams ..... F42B 3/103 102/202.5
5,178,547 A * 1/1993 Bonas ..... B60R 21/2644 439/34
5,200,574 A * 4/1993 Cunningham ..... B60R 21/2644 102/202.3
5,204,491 A * 4/1993 Aureal ..... F42B 3/198 102/202.8
5,275,575 A * 1/1994 Cahaly ..... H01R 13/7032 439/352
5,969,286 A * 10/1999 Ward ..... F42B 3/13 102/202.7
6,167,808 B1 * 1/2001 Mramor ..... H01R 24/58 280/743.1
6,230,625 B1 * 5/2001 Neyer ..... F42B 3/121 102/221
6,257,910 B1 * 7/2001 Mramor ..... F42B 3/182 439/507
6,644,198 B1 * 11/2003 Avetisian ..... H01R 24/005 280/741
7,192,054 B2 * 3/2007 Smith ..... F42B 3/04 280/741
7,267,569 B2 * 9/2007 Nakamura ..... H01R 13/623 439/353
7,614,875 B2 * 11/2009 Katsuda ..... B60R 21/26 280/741

(Continued)

*Primary Examiner* — Derrick R Morgan
(74) *Attorney, Agent, or Firm* — Reising Ethington P.C.

(57) ABSTRACT

An exploding foil initiator (EFI) assembly includes: a housing assembly, having a base, one or more elongated supports spaced about a circumference of the base extending axially away from the base, and protuberances extending radially-inwardly toward a central axis; a spring configured to compress a leadframe, an insulator, a pellet sleeve, and an explosive pellet; and a retainer cap with a surface that abuts the spring that releasably engages the protuberances and compresses the spring while engaged with the protuberances.

21 Claims, 6 Drawing Sheets

(56) References Cited

U.S. PATENT DOCUMENTS

| | | | | |
|---|---|---|---|---|
| 8,100,043 | B1 * | 1/2012 | Nance | H05K 1/181 102/202.5 |
| 8,210,083 | B1 * | 7/2012 | Nance | H05K 1/181 102/202.5 |
| 8,746,737 | B2 * | 6/2014 | Ozaki | C06D 5/00 280/741 |
| 10,663,269 | B2 * | 5/2020 | Gordon | B60R 16/023 |
| 10,794,670 | B1 * | 10/2020 | Nance | F42B 3/11 |
| 11,084,454 | B2 * | 8/2021 | Knollhuber | F42B 3/107 |
| 2005/0009390 | A1 * | 1/2005 | Barker | H01R 13/627 439/188 |
| 2005/0126416 | A1 * | 6/2005 | Clark | F42B 3/195 102/202.12 |
| 2005/0235858 | A1 * | 10/2005 | Reynolds | F42B 3/121 102/202.14 |
| 2009/0114109 | A1 * | 5/2009 | Overton | F42B 3/11 280/741 |
| 2013/0305948 | A1 * | 11/2013 | Hinkofer | F42B 3/124 102/202.7 |
| 2020/0198571 | A1 * | 6/2020 | Knollhuber | B60R 22/4628 |
| 2024/0294138 | A1 * | 9/2024 | Fukushima | F42B 3/125 |

* cited by examiner

MODULAR EXPLODING FOIL INITIATOR ASSEMBLY

TECHNICAL FIELD

The present application relates to exploding foil initiators and, more particularly, to modular assemblies including the exploding foil initiators.

BACKGROUND

Explosive devices typically include a payload of ordinance and a mechanism for initiating an explosive detonation of the payload. The explosion can be detonated in a variety of ways. In the past, explosives have been detonated using exploding bridgewire detonators. However, modern explosive materials may be detonated or otherwise ignited using exploding foil initiators (EFIs). EFIs provide several advantages relative to the exploding bridgewire initiators. However, packaging the components of EFIs can be challenging.

SUMMARY

In one implementation, a exploding foil initiator (EFI) assembly includes: a housing assembly, having a base, one or more elongated supports spaced about a circumference of the base extending axially away from the base, and protuberances extending radially-inwardly toward a central axis; a spring configured to compress a leadframe, an insulator, a pellet sleeve, and an explosive pellet; and a retainer cap with a surface that abuts the spring that releasably engages the protuberances and compresses the spring while engaged with the protuberances.

In another implementation, an EFI assembly includes a housing assembly, having a base, one or more elongated supports spaced about a circumference of the base extending axially away from the base, and protuberances extending radially-inwardly toward a central axis; a leadframe; having a plurality of elongated conductors, received by the housing assembly; a pellet sleeve received coaxially within the housing assembly, having an inner diameter; an insulator having a metallic foil attached to a surface; an explosive pellet received within the inner diameter of the pellet sleeve; a spring configured to compress the leadframe, the insulator, the pellet sleeve, and the explosive pellet; and a retainer cap, with a surface that abuts the spring, that releasably engages the protuberances and compresses the spring while the retainer cap is engaged with the protuberances.

DETAILED DESCRIPTION

An exploding foil initiator (EFI) assembly, sometimes referred to as a slapper detonator, can include components the spatial arrangement of which are carefully coordinated to ensure functionality and reliability. EFI assemblies can be used to detonate explosive devices, such as ordinance used in a bomb or a solid propellant used to propel rockets or other projectiles. It can be challenging to create a housing assembly that precisely arranges the components yet also can be formed easily and cost effectively. The EFI assembly can include an annular housing that receives a microprocessor, a leadframe having electrical conductors coupled to the microprocessor, and an insulator, with a metallic foil affixed to the insulator configured to electrically couple to the electrical conductors of the leadframe. The EFI assembly can also include a pellet sleeve that abuts the insulator and positions an explosive pellet relative to the insulator. The leadframe, insulator, pellet sleeve, and pellet can be received within the housing assembly and held in position by a spring that axially compresses the elements together within a housing assembly. A retaining cap can releasably engage with an open end of the annular housing to compress a spring that axially constrains the leadframe, insulator, pellet sleeve, and pellet together within the housing assembly. However, the retaining cap can be disengaged from the housing assembly to relatively easily permit the assembly/disassembly of the leadframe, insulator, pellet sleeve, and pellet. The annular housing can be formed or molded from a plastic or composite material.

Figure 1:
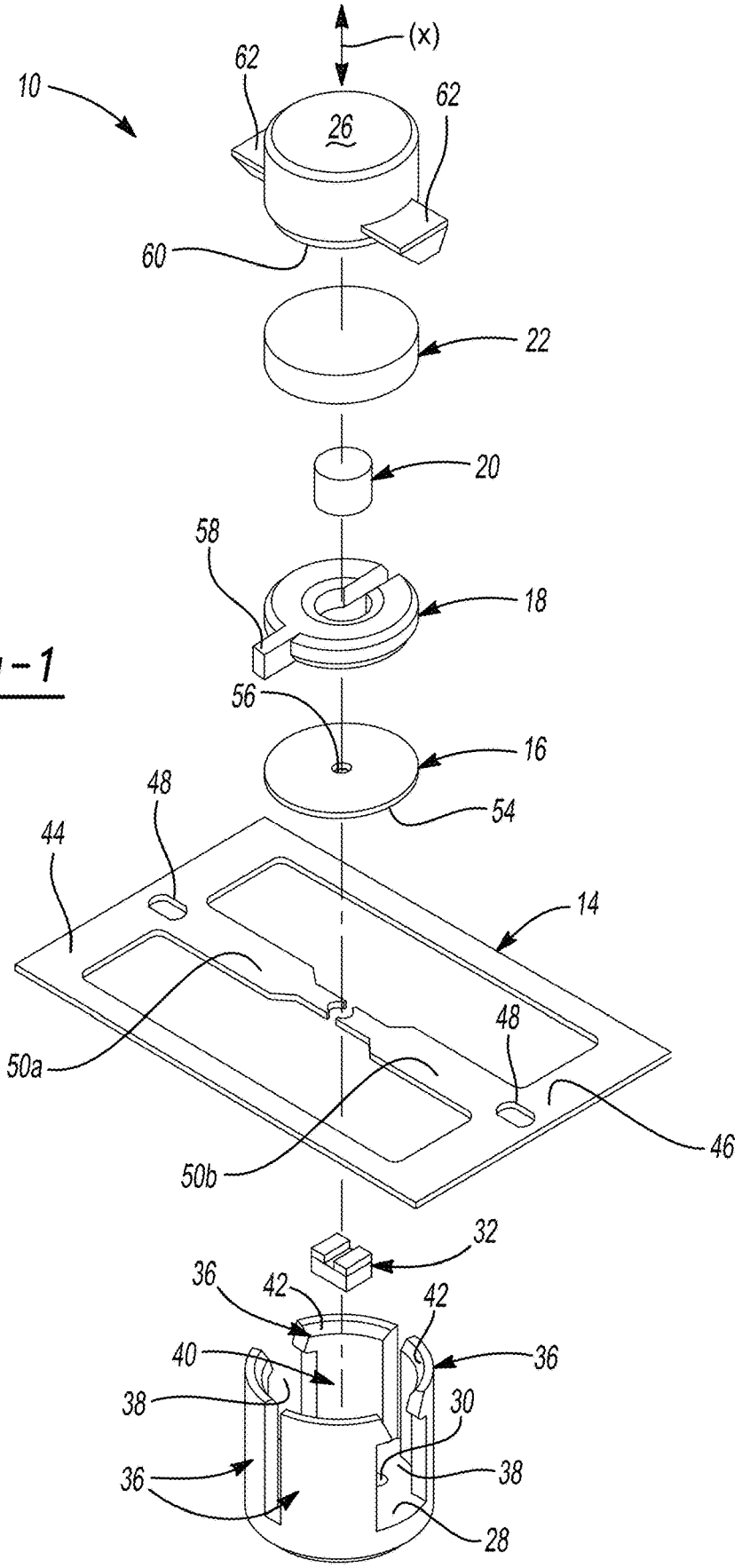
FIG. 1 is an exploded view depicting an implementation of an exploding foil initiator assembly.
Figure 2:
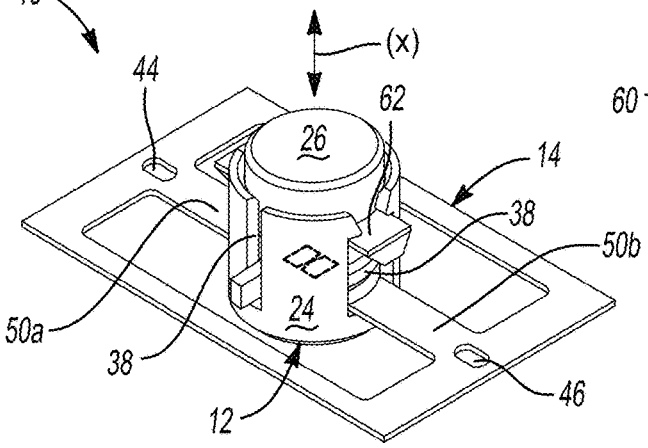
FIG. 2 is a perspective view depicting an implementation of an exploding foil initiator assembly.
Figure 4:
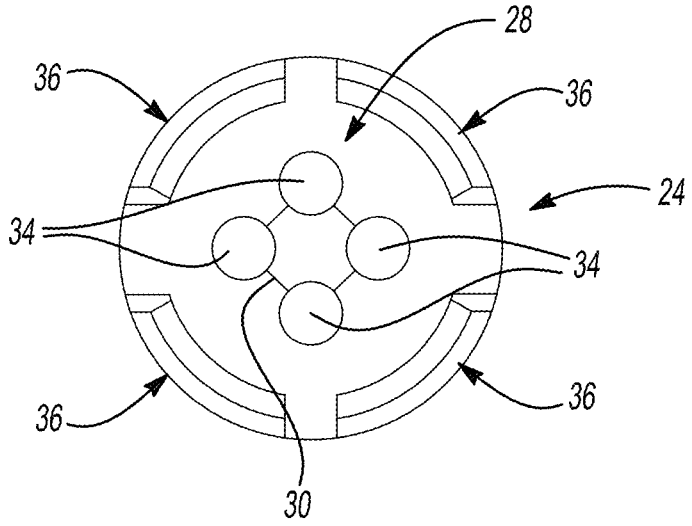
FIG. 4 is a plan view depicting a portion of an implementation of an exploding foil initiator assembly.
Figure 5:
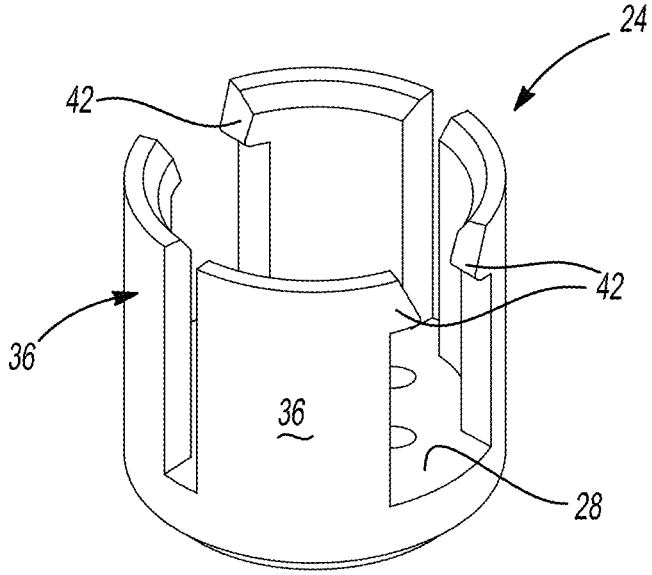
FIG. 5 is a perspective view depicting a portion of an implementation of an exploding foil initiator assembly.
Figure 6:
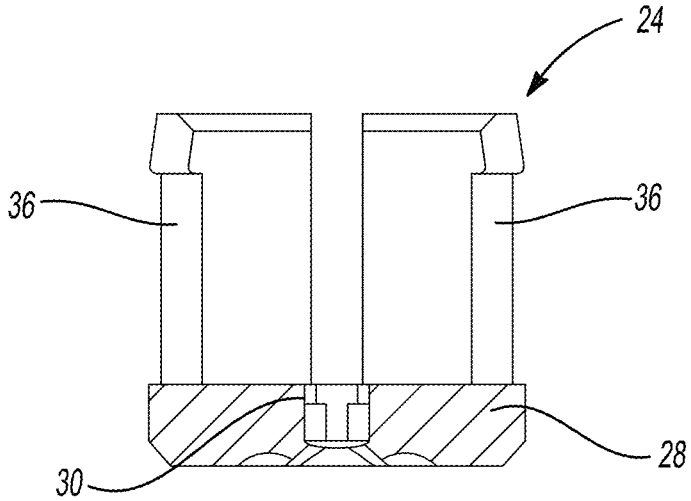
FIG. 6 is a cross-sectional view depicting a portion of an implementation of an exploding foil initiator assembly.
Figure 7:
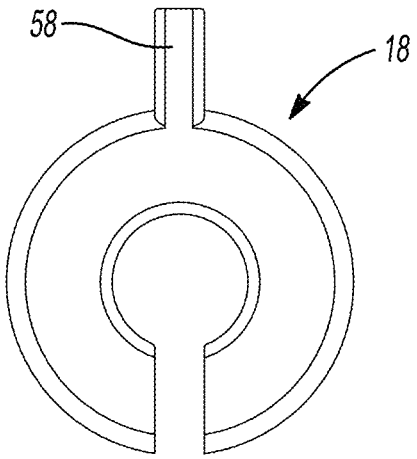
FIG. 7 is a plan view depicting another portion of an implementation of an exploding foil initiator assembly.
Figure 8:
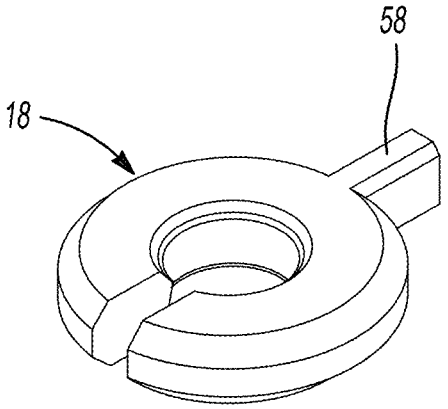
FIG. 8 is a perspective view depicting another portion of an implementation of an exploding foil initiator assembly.
Figure 9:
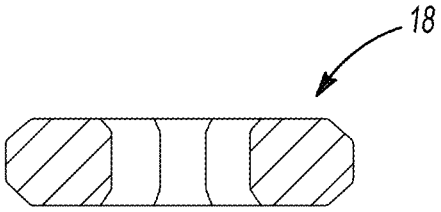
FIG. 9 is a cross-sectional view depicting another portion of an implementation of an exploding foil initiator assembly.
Figure 10:
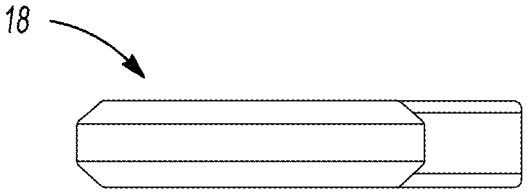
FIG. 10 is a profile view depicting another portion of an implementation of an exploding foil initiator assembly.
Figure 11:
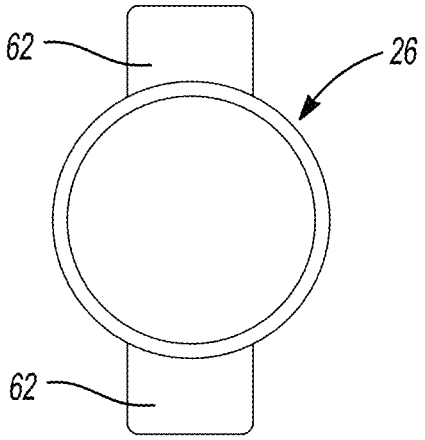
FIG. 11 is a plan view depicting another portion of an implementation of an exploding foil initiator assembly.
Figure 12:
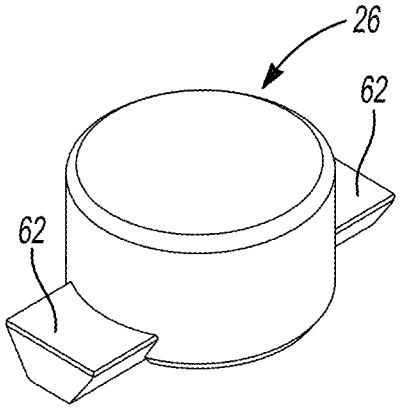
FIG. 12 is a perspective view depicting another portion of an implementation of an exploding foil initiator assembly.
Figure 13:
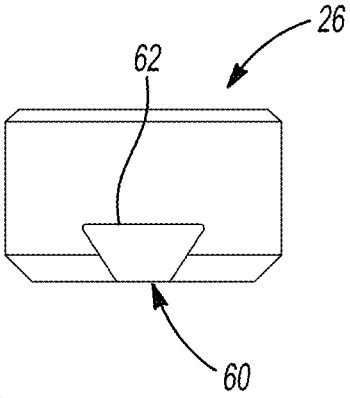
FIG. 13 is a profile view depicting another portion of an implementation of an exploding foil initiator assembly.
Figure 14:
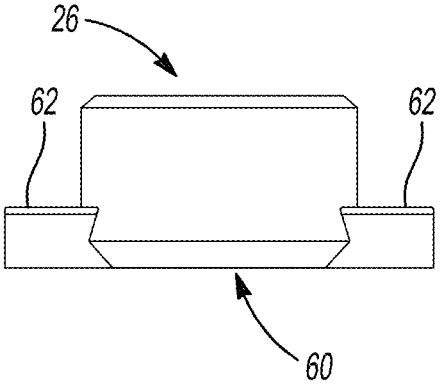
FIG. 14 is a profile view depicting another portion of an implementation of an exploding foil initiator assembly.

Turning to FIGS. 1-2, an implementation of an EFI assembly 10 is shown. The EFI assembly 10 includes a housing assembly 12, a leadframe 14, an insulator 16, a pellet sleeve 18, an explosive pellet 20, and a spring 22 (these elements may be referred to later as the "components" of the EFI assembly 10). The housing assembly 12 can include an annular housing 24 (shown in more detail in FIGS. 4-6) and a retainer cap 26 (shown in more detail in FIGS. 11-14) that releasably couples to the annular housing 24 to axially compress and constrain the leadframe 14, the insulator 16, the pellet sleeve 18, the explosive pellet 20, and the spring 22. The annular housing 24 can include a base 28 having a receptacle 30 for receiving and positioning a microchip 32 within the housing assembly 12. The receptacle 30 can closely conform to an outer surface of the microchip 32, such that the receptacle 30 firmly positions the microchip 32 within the annular housing 24. In addition, the base 28 can include one or more apertures 34 for receiving threaded fasteners (not shown) that can secure the EFI assembly 10 within its environment. The base 28 can be formed from a solid substrate having a substantially circular shape and a thickness sufficient to resists bending or flexing.

One or more elongated supports 36 can couple to or axially extend from the base 28 along a central axis (x). The elongated support(s) 36 can be spaced about a circumference of the base 28, as well as spaced apart to leave a distance between adjacent elongated supports 36, forming slots 38 sized to receive a least a portion of the EFI assembly 10. The elongated supports 36 can have an arcuate cross-sectional shape such that as they are spaced around the circumference of the base 28 and can collectively form an annular cavity 40 for receiving the components of the EFI assembly 10 and resiliently locating the components within the annular cavity 40 relative to the central axis (x). The elongated supports 36 can include a barb or protuberance 42 positioned at an end of the elongated support 36 that is distal to the base 28, extending substantially perpendicularly relative to the elongated support 36 toward the central axis (x). The housing assembly 12, including the base 28, the elongated supports 36, and the retainer cap 26 can be formed from a plant-based resin. In some implementations, the components of the housing assembly 12 can be formed using female molds having the shape of the components, and the plant-based resin can be introduced to the female molds in a liquid state and allowed to harden to a solid. Once solid, the components can be removed from the female molds and assembled with the other components of the EFI assembly 10.

The leadframe 14 can be substantially planar and formed from an electrically-conductive material. In one implementation, the leadframe 14 can include a first terminal 44 and a second terminal 46 that may be formed from a film of the electrically-conductive material. The film of electrically-conductive material can initially exist as a roll that includes apertures 48 that manufacturing machinery engages to move the roll linearly along a production line where the shape or form of the leadframe 14 is created. The shape of the leadframe 14 could be created using punch dies or other similar cutting techniques. As shown, the first terminal 44 and the second terminal 46 extend radially inwardly toward the microchip 32 and each also include elongated conductors 50*a*/50*b* that extend radially inwardly toward the central axis (x) to electrically engage the microchip 32, such that the first terminal 44 and the second terminal 46 conduct electrical current to the microchip 32 from the electrical source. The conductors 50*a*/50*b* can be soldered to the microchip 32 thereby creating an electrically-conductive connection. Once soldered, the first and second terminals 44/46 and the corresponding conductors 50*a*/50*b* can be severed from the leadframe 14. The width of the elongated conductors 50 can be defined to fit within the slots 38 in between the elongated supports 36 such that the edges of the elongated conductors 50 abut the slots 38 and hold the leadframe 14 in a fixed position relative to the EFI assembly 10.

Figure 3:
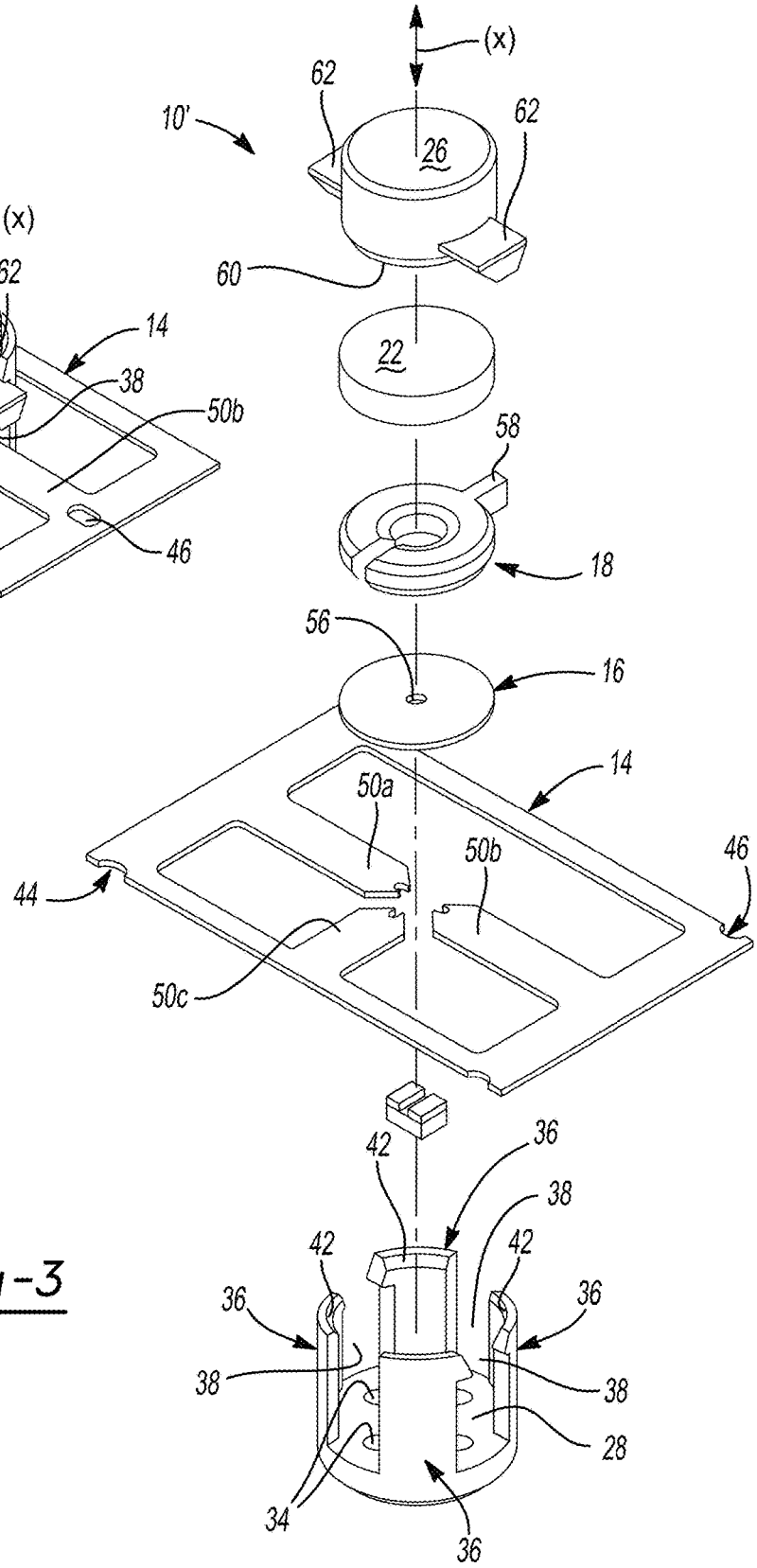
FIG. 3 is an exploded view depicting another implementation of an exploding foil initiator assembly.

The elongated conductors 36 can have distal ends 52 that are shaped in one of a variety of ways depending on the microchip 32 used with the EFI assembly 10. For example, turning to FIG. 3, another implementation of an EFI assembly 10' is shown. In this implementation, the leadframe 14' includes three elongated conductors 50*a-c* for electrically coupling to the microchip 32.

The insulator 16 can be formed from a dielectric material and have an outer circumference that is substantially circularly shaped to closely conform to the inner diameter of the annular cavity 40. In one implementation, the dielectric material can be a polyamide, such as Kapton, but other implementations are possible. The insulator 16 can include an inner diameter that forms an insulator barrel 56 for guiding a molten portion of polyamide, created in response to a flow of electrical current to the microchip 32, along the central axis (x) towards the explosive pellet 20.

The microchip 32, received by the base 28, can be implemented using one of a number of different configurations. For example, one implementation is the RSI-195-01 chip manufactured by Reynolds Industries. However, other types of low energy exploding foil initiator (LEEFI) chips could be used in the EFI assembly 10. The microchip 32 can include an electrically-conductive bridge (not shown) formed from a metallic foil that electrically couples to the first terminal and 44 and the second terminal 46. A layer of polyamide can be positioned adjacent the conductive bridge and, when electrical current is applied to the electrically-conductive bridge, a portion of the metallic foil 54 can travel through the insulator barrel 16 into the explosive pellet 20, thereby igniting the explosive material of the explosive pellet 20.

A pellet sleeve 18, shown in more detail in FIGS. 7-10, and an explosive pellet 20 can be included in the EFI assembly 10 axially adjacent to the insulator 16 along the central axis (x). The pellet sleeve 18 can include a substantially circular outer diameter that closely conforms to the inner diameter of the annular cavity 40, and an inner diameter that closely conforms to an outer diameter of the explosive pellet 20. The pellet sleeve 18 can include a locating member 58 affixed to or emerging from the outer diameter of the pellet sleeve 18 and extending radially outwardly away from the central axis (x), having have a width that is sized to fit into the slots 38 and abut adjacent elongated supports 36. The locating member 58 can position the pellet sleeve 18 relative to the annular housing 24 and the explosive pellet 20 coaxially with the central axis (x). The pellet sleeve 18 can be substantially C-shaped such that the inner diameter surface and the outer diameter surface are not continuous. The pellet sleeve 18 can be formed from any one of a variety of different electrically-insulating materials, such as a ceramic material or resin-impregnated fiberglass. The axial length measured along the central axis (x) or thickness of the pellet sleeve 18 can be approximately the axial length of the explosive pellet 20 such that a radial surface of the explosive pellet 20 is substantially flush with the pellet sleeve 18 when assembled as part of the EFI assembly 10. However, the explosive pellet 20 can be axially displaced relative to the pellet sleeve 18 depending on the amount of axial force exerted on the explosive pellet 20 by the spring 22. This will be discussed in more detail below.

The explosive pellet 20 can have an outer diameter that is sized to closely fit within or abut the inner diameter of the pellet sleeve 18. The explosive pellet 20 can be formed in a substantially cylindrical shape and comprise any one of a number of explosive materials, such as RSI-786-03 manufactured by Reynolds Systems, Inc. However, the explosive pellet 20 can be differently shaped and/or comprise a different explosive material.

The spring 22 can be sized to be compressible between the components within the housing assembly 12 and the retainer cap 26, exerting an axially-directly force along the central axis (x). The term "spring" should be broadly interpreted as an elastic member or biasing element that exerts axial force when compressed. In one implementation, the spring 22 can be a circularly-shaped disk formed from a compressible material, such as Poron™ or a closed-cell foam that, when compressed, exerts force in an axial direction along the central axis (x). The thickness or axial length of the spring 22 implemented using foam can be chosen based on an axial space within the housing assembly 12 and/or the amount of axial force to be exerted on the leadframe 14, the insulator 16, the pellet sleeve 18, and the explosive pellet 20 within the housing assembly 12 while the retainer cap 26 is coupled with the annular housing 24. The amount of axial force can be selected to axially compress the components to create a distance between the polyamide to be ignited by the microchip 32 for detonation and the explosive pellet 20 that falls within a range of 5-9 thousandths of an inch in one implementation or, more precisely, could fall within a range of 5-6 thousandths of an inch. In this sense, the spring 22 can be designed so that is provides sufficient axial force to compress the components to create the desired distance between the ignited polyamide and the explosive pellet 20. However, it should be appreciated that other implementations of springs are possible. Other types of elastic members/biasing elements that axially compress the components within the EFI assembly 10 could be used. For example, a coil spring or planar spring could be used within the housing assembly 12 to axially compress the leadframe 14, the insulator 16, the pellet sleeve 18, and the explosive pellet 20 within the housing assembly 12 when the retainer cap 26 is coupled with the annular housing 24.

The retainer cap 26 can axially constrain the components of the EFI assembly 10 within the housing assembly 12. In one implementation, the retainer cap 26 can be formed as a cylinder that is closed on one end creating a retainer cavity 60 for enclosing at least a portion of the components of the EFI assembly 10. The retainer cap 26 can include a plurality of ears 62 that extend radially outwardly away from the central axis (x) from the outer diameter of the retainer cap 26 for releasably engaging the elongated supports 36 to compress the spring 22, thereby compressing the components of the EFI assembly 10. The microchip 32 can be positioned within the annular cavity 40 in the receptacle 30, the leadframe 14 axially adjacent the microchip 32, and the insulator 16 abutting the microchip 32 via the metallic foil 54.

The elongated supports 36 can move or deflect radially away from the central axis (x) to permit the compression of the components within the annular cavity 40 against the retainer cap 26 such that, when released, the elongated supports 36 move radially toward the central axis (x) to a default position such that the barbs/protuberances 42 engage a surface of the retainer cap 26 and maintain a compressive force on the spring 22 and the components within the annular housing 24. The pellet sleeve 18 and explosive pellet 20 can be positioned in the annular cavity 40 axially adjacent to the insulator 16 along the central axis (x). The spring 22 can be positioned to axially abut the pellet sleeve 18 and the retainer cap 26 can axially slide over the pellet sleeve 18, the explosive pellet 18, and the spring 22, forced toward the base 28 of the annular housing 24 until the ears 62 abut the barb or protuberance 42, momentarily move the elongated supports 36 radially away from the central axis (x) until the retainer cap 26 moves close enough to the base 28 that the barbs/protuberances 42 can engage an outer surface of the retainer cap 26 and maintain compression of the components of the EFI assembly 10. The retainer cap 26 can be disengaged from the elongated supports 36 by moving the elongated supports 36 radially away from the central axis (x) so that the barbs or protuberances 42 release tension with the outer surface of the retainer cap 26.

Figure 15:
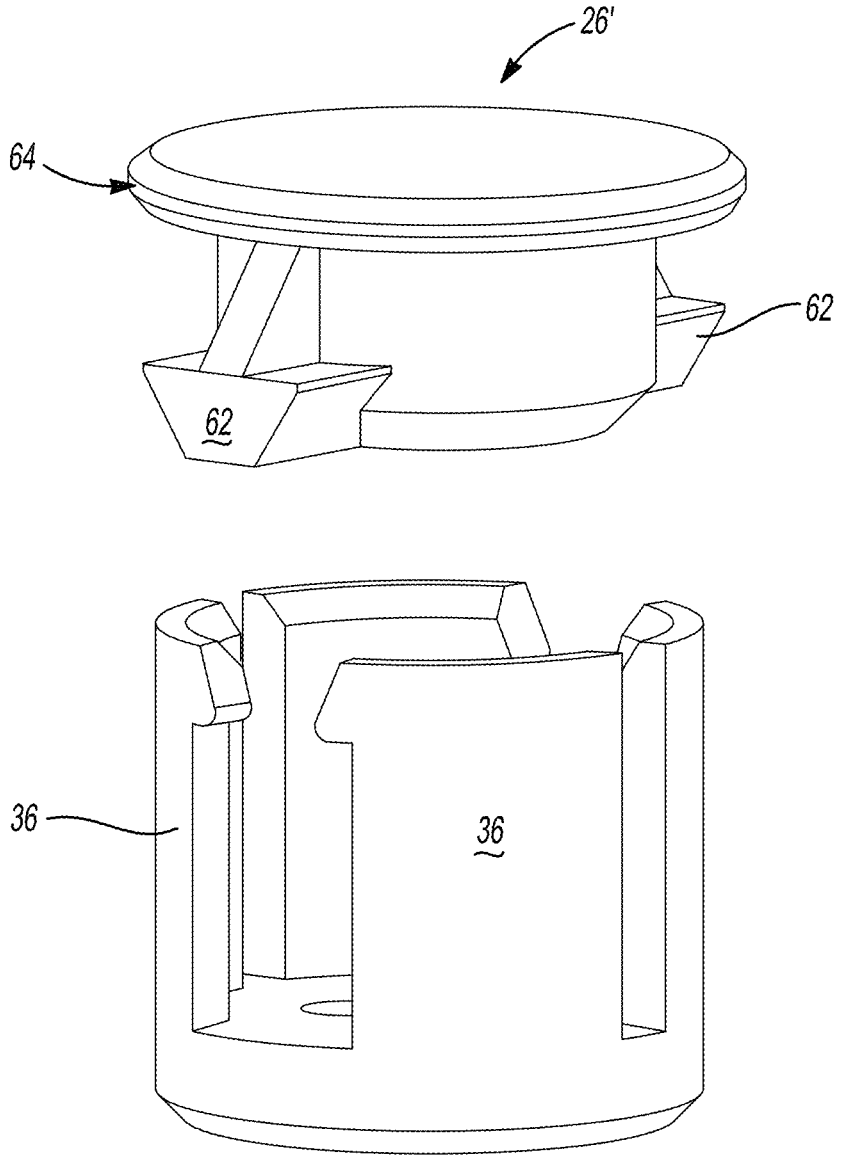
FIG. 15 is a perspective view depicting another portion of an implementation of an exploding foil initiator assembly

Turning to FIG. 15, another implementation of a retainer cap 26' is shown. The EFI assembly 10 can use a physical stop preventing the spring 22 from over compressing the components and possibly damaging the microchip 32. In one implementation, the retainer cap 26' can implement the physical stop using a radially-outwardly-extending rim 64 included at a distal end 66 of the retainer cap 26'. As the EFI assembly 10 is assembled, the radially-outwardly-extending rim 64 can prevent the axial movement of the retainer cap 26' relative to the annular housing 24 such that the radially-outwardly-extending rim 64 abuts the elongated supports 36 preventing the spring 22 from exterting too much pressure on the components of the EFI assembly 10. The radially-outwardly-extending rim is one way of preventing axial movement of the retainer cap relative to the annular housing. However, other implementations exist to accomplish this. For purposed of interpretation, the term "radially-outwardly-extending rim" should be broadly construed to mean "physical stop between the two components." In another example, an inner surface of at least one elongated support can include a stop extending radially inwardly into the annular cavity 40 to limit the axial movement of the pellet sleeve 18 toward the microchip 32.

It is to be understood that the foregoing is a description of one or more embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "e.g.," "for example," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

What is claimed is:

1. An exploding foil initiator (EFI) assembly, comprising:
- a housing assembly, having a base, elongated supports spaced about a circumference of the base extending axially away from the base, and protuberances extending away from a distal end of the elongated supports;
- an elastic member configured to compress a leadframe, an insulator, a pellet sleeve, and an explosive pellet; and
- a retainer cap with a surface that abuts the elastic member spring that releasably engages the protuberances and the retainer cap compresses the elastic member to direct an axial force received from the retainer cap towards the base while engaged with the protuberances.

2. The EFI assembly recited in claim 1, wherein the elastic member is formed from foam.

3. The EFI assembly recited in claim 1, wherein the housing assembly further comprises an annular housing having an annular cavity.

4. The EFI assembly recited in claim 1, wherein the housing assembly is formed from a plant-based resin.

5. The EFI assembly recited in claim 1, wherein the housing assembly includes a receptacle for a microprocessor.

6. The EFI assembly recited in claim 1, wherein the leadframe includes two or more terminals.

7. The EFI assembly recited in claim 1, wherein the leadframe includes three terminals.

8. The EFI assembly recited in claim 1, wherein the pellet sleeve includes a locating member extending radially outwardly away from the central axis, and the locating member abuts adjacent elongated supports.

9. The EFI assembly recited in claim 1, wherein the pellet sleeve has a non-continuous inner diameter and outer diameter.

10. The EFI assembly recited in claim 1, wherein the retainer cap includes a plurality of ears that releasably engage with the protuberances.

11. An exploding foil initiator (EFI) assembly, comprising:

a housing assembly, having a base, elongated supports spaced about a circumference of the base extending axially away from the base, and protuberances extending away from a distal end of the elongated supports;

a leadframe having a plurality of elongated conductors, received by the housing assembly;

a pellet sleeve received coaxially within the housing assembly, having an inner diameter;

an insulator having a metallic foil attached to a surface;

an explosive pellet received within the inner diameter of the pellet sleeve;

an elastic member configured to compress the leadframe, the insulator, the pellet sleeve, and the explosive pellet; and a retainer cap, with a surface that abuts the elastic member, that releasably engages the protuberances and the retainer cap compresses the elastic member to direct an axial force received from the retainer cap towards the base while the retainer cap is engaged with the protuberances.

12. The EFI assembly recited in claim 11, wherein the elastic member is formed from foam.

13. The EFI assembly recited in claim 11 wherein the housing assembly further comprises an annular housing having an annular cavity.

14. The EFI assembly recited in claim 11, wherein the housing assembly is formed from a plant-based resin.

15. The EFI assembly recited in claim 11, wherein the housing assembly includes a receptacle for a microprocessor.

16. The EFI assembly recited in claim 11, wherein the leadframe includes two or more terminals.

17. The EFI assembly recited in claim 11, wherein the leadframe includes three terminals.

18. The EFI assembly recited in claim 11, wherein the pellet sleeve includes a locating member extending radially outwardly away from the central axis, and the locating member abuts adjacent elongated supports.

19. The EFI assembly recited in claim 11, wherein the pellet sleeve has a non-continuous inner diameter and outer diameter.

20. The EFI assembly recited in claim 11, wherein the retainer cap includes a plurality of ears that releasably engage with the protuberances.

21. An exploding foil initiator (EFI) assembly, comprising:

a housing assembly, having a base, elongated supports spaced about a circumference of the base extending axially away from the base, and protuberances extending away from a distal end of the elongated supports;

an elastic member formed from foam configured to compress a leadframe, an insulator, a pellet sleeve, and an explosive pellet; and a retainer cap with a surface that abuts the elastic member that releasably engages the protuberances and the retainer cap compresses the elastic member while engaged with the protuberances.

* * * * *